United States Patent [19]

Buckley et al.

[11] 4,406,056

[45] Sep. 27, 1983

[54] METHOD OF MAKING A CELLULOSE-FREE TRANSFORMER COIL

[75] Inventors: Richard D. Buckley, Watkinsville; Edward L. Boyd; Betty J. Palmer, both of Athens, all of Ga.

[73] Assignee: Westinghouse Electric Corp., Pittsburgh, Pa.

[21] Appl. No.: 308,315

[22] Filed: Oct. 2, 1981

[51] Int. Cl.[3] ..... H01F 41/06

[52] U.S. Cl. ..... 29/605; 336/205; 336/206; 427/116; 427/118

[58] Field of Search ..... 29/605; 336/205, 206; 427/116, 117, 118, 120, 420

[56] References Cited

U.S. PATENT DOCUMENTS

| | | | |
|---|---|---|---|
| 1,932,640 | 10/1933 | Rust | 336/206 X |
| 3,477,126 | 11/1969 | Price | 29/605 |
| 3,963,882 | 6/1976 | Lewis | 29/605 X |
| 4,095,557 | 6/1978 | Croop et al. | 29/605 X |

*Primary Examiner*—Carl E. Hall

*Attorney, Agent, or Firm*—L. P. Johns

[57] ABSTRACT

A coil structure for cellulose-free transformer coils characterized by at least three helically wound layers disposed in a reversal pattern with wedge-shaped resinous insulators between each layer.

4 Claims, 4 Drawing Figures

FIG. 1.
PRIOR ART
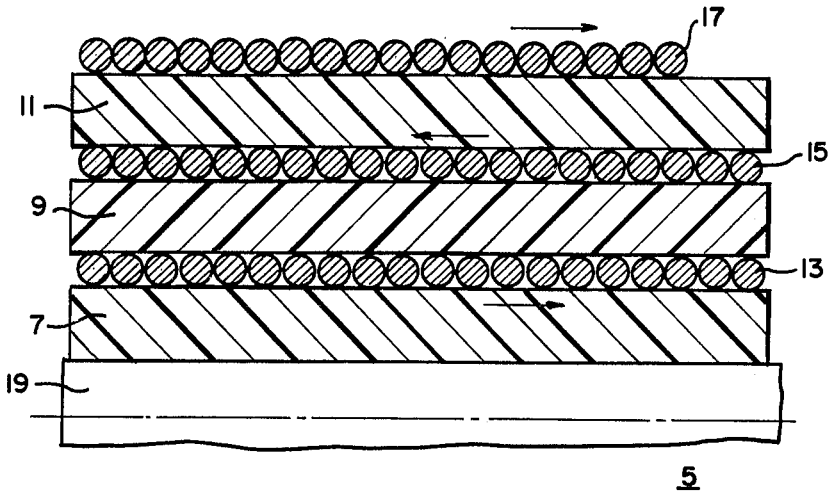
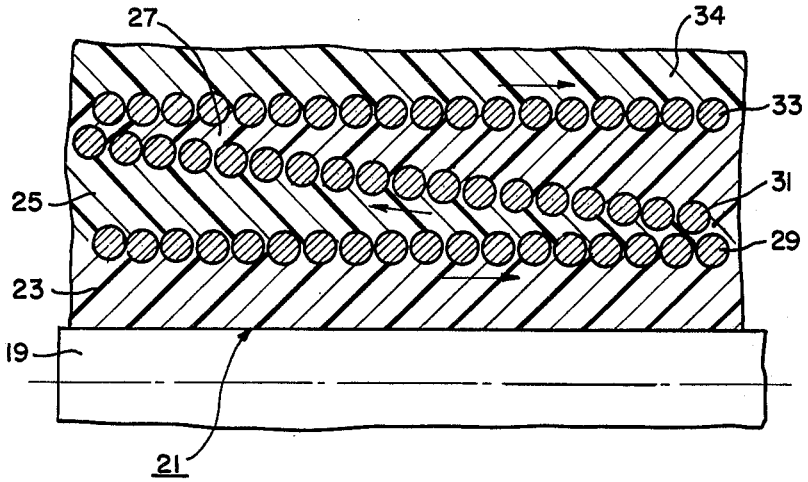
FIG. 2.

METHOD OF MAKING A CELLULOSE-FREE TRANSFORMER COIL

CROSS-REFERENCE TO RELATED APPLICATIONS

This invention is related to that disclosed in the applications of Richard D. Buckley, Ser. No. 264,151, filed May 15, 1981; and of Dean C. Westervelt, Ser. No. 308,314, filed Oct. 2, 1981.

BACKGROUND OF THE INVENTION

1. Field of the Invention:

This invention relates to a coil structure for a transformer and, more particularly, it pertains to a cellulose-free transformer coil construction.

2. Description of the Prior Art:

Conventionally wound transformer coils using round or rectangular enameled wire are designed with uniform layers of wire and paper spaced alternately. The winding sequence is that of applying turns of wire side-by-side helically around the central axis of the coil until a layer is completed. A layer of paper having the full width of the coil is then wrapped over the wire turns to provide insulation. With this insulation in place, the winding is continued with another layer of wire traversing in the opposite direction across the coil width. The dielectric stress from layer to layer is thus very low at one end of the coil and relatively high at the other end. Consequently, the coil size is influenced by the thickness of paper that must be applied to withstand the highest dielectric stress.

SUMMARY OF THE INVENTION

In accordance with this invention it has been found that a more satisfactory transformer coil may be provided which is devoid of cellulose, including a tubular coil structure having a plurality of turns of a spirally wound conductor forming a first layer, a first wedge-shaped resinous insulator coextensive with and around the first layer and having a thin edge at one end of the first layer and a thick edge at the other end thereof, a second layer of coil structure on the side of the first insulator opposite the first layer and comprising a plurality of additional spiral turns of the wound conductor, a second wedge-shaped resinous insulator coextensive with and around the second layer and having thin and thick edges oppositely disposed of the first insulator; a third layer on the side of the second insulator opposite the second layer and comprising a plurality of additional spiral turns of a wound conductor, and additional alternating wedge-shaped resinous insulators and layers of helically wound conductors as necessary.

The invention also comprises a method for making a noncellulose insulated transformer coil comprising the steps of providing a winding mandrel for repeated rotation past a resin applicator and a resin curing station, first applying a number of layers of resin spirally onto the mandrel, coiling a number of turns of a pre-insulated conductor helically onto and over the layers of resin forming a tubular winding, applying a layer of resin onto each turn of said conductor while applying another layer of resin onto resinous layers on prior wound turns to form a body of insulating resin, curing each layer of resin as the mandrel rotates by the resin curing station, coiling a number of turns of a conductor helically onto and over the previously applied resin in the reverse direction from that of the previously wound layer, applying a layer of resin onto each previously applied turn of said conductor while applying another layer of resin over resinous layers of prior wound turns to form a body of insulating resin, curing each layer of resin applied as the mandrel rotates by the curing station, and coiling a number of turns of the conductor helically onto and over the previously applied layers of resin in a direction similar to the first tubular winding.

The advantage of the device of this invention is that the coil structure, comprising a resinous insulator rather than a cellulose insulator, is more durable than coils embodying cellulosic insulators.

BRIEF DESCRIPTION OF THE DRAWINGS

FIG. 1 is a cross-sectional view through a coil structure of prior art construction;

FIG. 2 is a cross-sectional view of a coil structure in accordance with this invention;

DESCRIPTION OF THE PREFERRED EMBODIMENT

Figure 3:
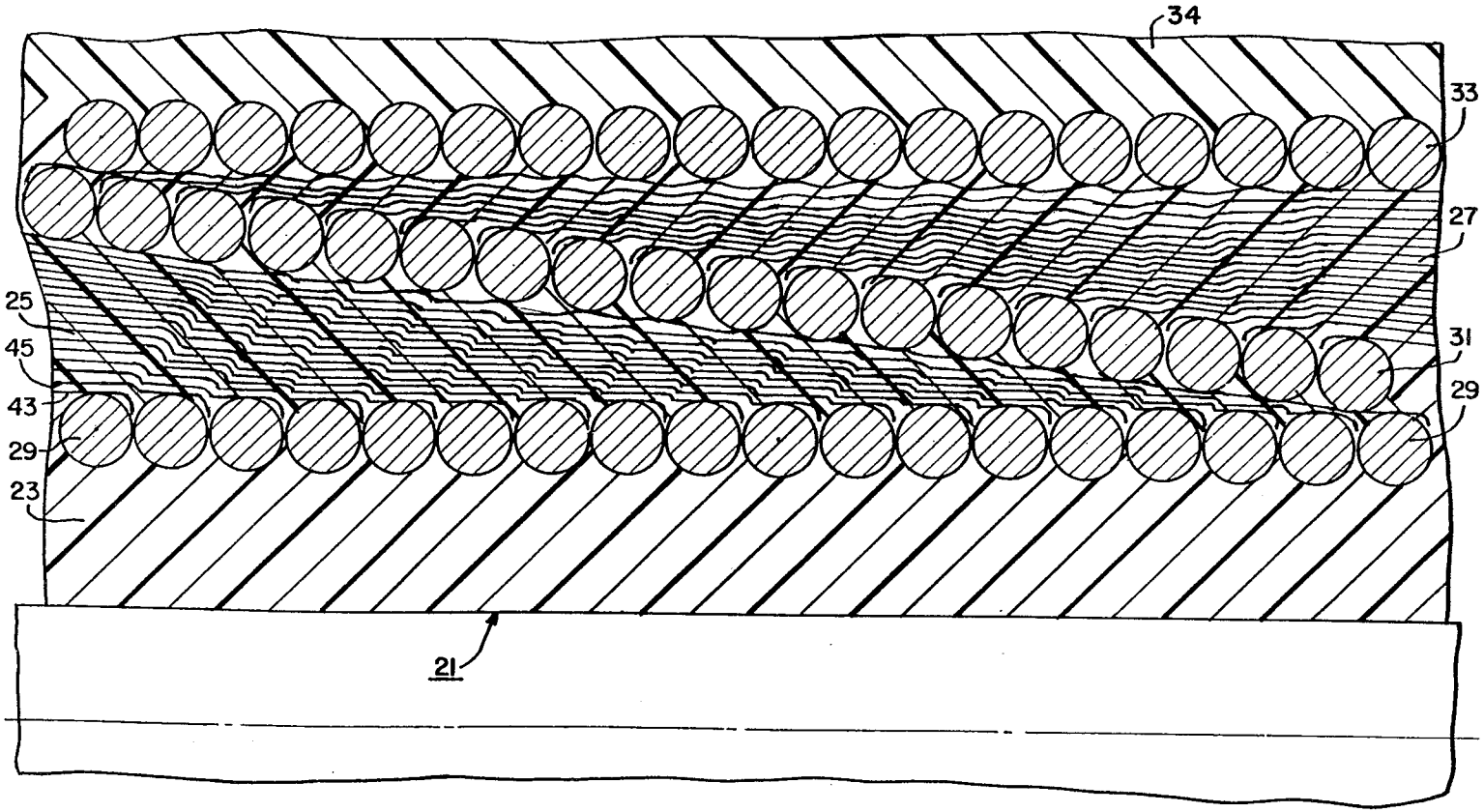
FIG. 3 is a fragmentary sectional view, enlarged over the view of FIG. 2 to show the layers of resin as applied in accordance with this invention.

In FIG. 1 a partial transformer coil of prior art construction is generally indicated at 5. It comprises concentrically disposed tubes 7, 9, 11 for holding layers 13, 15, 17 in spaced relationship with respect to each other. The tubes 7, 9, 11 are composed of cellulose, such as cardboard, and formed by winding the inner tube 7 onto a rotated mandrel 19. The layer 13 is wound from the left to the right end (FIG. 1). After the cellulosic tube 9 is applied, the winding continues with the same conductor to form the layer 15 from the right to the left. The cellulosic tube 11 is then applied and winding continues from the left to the right end. Thus, the several layers 13, 15, 17 are provided in substantially concentric patterns with the same enameled conductor being wound continuously for all three layers.

In accordance with this invention it has been found that a coil structure generally indicated at 21 (FIG. 2) may be provided which comprises insulators 23, 25, 27 for mounting conductor windings or layers 29, 31, 33 in place. The insulators 25, 27 are wedge-shaped bodies so that the configuration of the assembled layers 29, 31, 33 has a reversing or zig-zag configuration.

Moreover, though only three layers 29, 31, 33 are shown, more conductor layers and wedge-shaped insulators may be provided as required. Finally, the outer layer of conductor is covered with a layer 34 of resin similar to that of the insulator 23.

Figure 4:
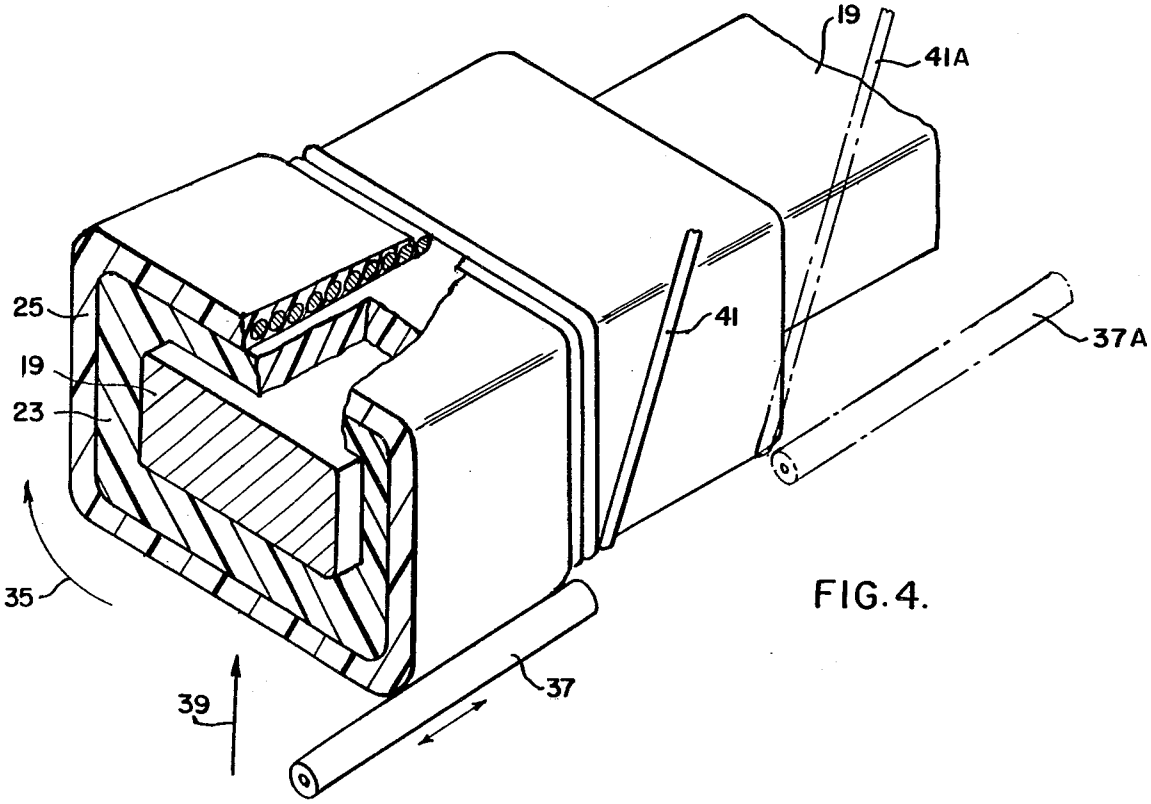
FIG. 4 is an isometric view of a transformer coil structure of this invention during winding.

The method by which the coil structure 21 is made in shown in FIG. 4. In accordance with the invention, the insulator 23 is applied to the outer surface of the mandrel 19 which is rotated in the direction of the arrow 35. The insulator 23 preferably consists of a cross linkable resin which is applied in any suitable manner such as by a roller 37. As the mandrel 19 rotates, the resin is applied and carried past a resin curing station which preferably consists of an ultraviolet radiator.

After the requisite number of layers of resin are applied to provide the desired thickness of the insulator 23, the conductor turns which form layers 29 are applied. The windings or layers comprise the turns of a continuous conductor, such as copper, having an insulated coating, such as enamel. As the mandrel is rotated and the turns 29 are applied from a strand 41 of a continuous conductor or wire, the strand advances along and over the outer surface of the insulator 23 until it reaches the broken line position 41A. As the wire layer 29 is wound onto the insulator 23, the roller 37 for applying the resin advances with the strand 41 to apply a layer 43 (FIG. 3) of resin onto each turn as it is positioned in place. Continued rotation of the assembly causes the first layer 43 to be cured as it passes the curing station indicated by an arrow 39. As the subsequent turns of the wire conductor are applied to form the layer 29, each turn of the layer is coated with a layer 45 of resin and the previous layer 43 is coated with the same resin layer 45. Ultimately the number of resin layers 43, 45 equals the number of turns of wire forming the layer 29 so that the wedge-shaped insulator 25 is evolved. Thus, it consists of a plurality of separately cured layers 43, 45, etc.

The conductor layer 31 is then applied by continuing to rotate the mandrel and advancing the strand 41 in the direction opposite that for applying the first layer 29. Likewise, the roller, shown in the broken line position 37A, advances with each turn of the wire to apply individual layers of resin across the coil structure with each layer being cured and subsequently being covered with multiple layers of cured resin until the strand 41 reaches the left end of the coil as shown in FIG. 2. At this point the wedge-shaped insulator 27 is also completed.

Thereafter, the process similar to that for applying the layer 29 is followed for applying the conductor layer 33 and any subsequent layer or layers similar to 29 and 31. Finally, when the last layer is applied, an outer coating 34 is applied to the outermost layer of the coil structure.

An alternative to the foregoing is to apply resin to a group of turns at one time so that the number of layers of insulation is less than the number of layers of wire.

In conclusion, the cellulose-free coil structure as set forth above enables the use of conventional wire wound layers with reduced total insulation thickness. The concept employs a resin applicator, such as a paint roller. The thin film of resin is immediately jelled by radiation, such as ultraviolet, and as each turn is applied the applicator adds a thin film of layer resin to the entire partial layer. The resulting finished coil is significantly smaller because the volume of insulation is reduced by one half over the conventional structure while the maximum dielectric stress within the coil is unchanged. This technique also allows the application of resin in thin layers while still providing for the necessary resin thickness to protect the area of maximum dielectric stress.

What is claimed is:

1. A method for making a non-cellulose insulated transformer coil comprising the steps of:

(a) providing a winding mandrel for repeated rotation past an uncured resin applicator and a resin curing station;

(b) applying a number of first layers of resin spirally onto a mandrel;

(c) coiling a number of turns of a conductor helically onto and over the layers of resin forming a tubular winding;

(d) applying a layer of resin onto each turn of said conductor and onto the layer of resin covering the immediately preceding turns of each winding, the application of each resinous layer extending from the end of the winding where the winding turns commence without covering the resinous layers ahead of and onto which the turns are being coiled so as to provide a wedge-shaped body of insulating resin;

(e) jelling each layer of resin as the mandrel rotates by the resin curing station;

(f) coiling a number of turns of the conductor helically onto and over the layers of jelled resin applied at step (d) in the reverse direction of that coiled at step (c);

(g) applying a layer of resin onto each turn of said conductor at step (f) while applying another layer of resin over resinous layers on prior wound turns at step (f) to form a body of insulating resin;

(h) jelling each layer of resin applied at step (g) as the mandrel rotates by the curing station; and (i) coiling a number of turns of the conductor helically onto and over the layers of jelled resin applied at step (g) in a direction similar to that of step (c).

2. The method of claim 1 in which the outermost coil of conductors is covered with a coating of a cross linkable resin.

3. The method of claim 1 in which the steps (d) through (i) are repeated.

4. The method of claim 2 in which the body of insulating resin at step (g) has a wedge-shaped cross-section disposed in a direction opposite that formed at step (d).

* * * * *